United States Patent [19]

Schmidt

[11] 4,270,677

[45] Jun. 2, 1981

[54] RECLOSABLE CROSS-BOTTOM SACK

[75] Inventor: Horst Schmidt, Kattenvenne, Fed. Rep. of Germany

[73] Assignee: Windmöller & Hölscher, Lengerich, Fed. Rep. of Germany

[21] Appl. No.: 72,679

[22] Filed: Sep. 5, 1979

[30] Foreign Application Priority Data

Sep. 6, 1978 [DE] Fed. Rep. of Germany ..... 2838859

[51] Int. Cl.[3] ..... B65D 30/12; B65D 83/00

[52] U.S. Cl. ..... 222/561; 222/541; 229/60; 229/62

[58] Field of Search ..... 222/541, 559, 561; 150/3; 229/62, 60, 58; 206/601, 604

[56] References Cited

U.S. PATENT DOCUMENTS

| | | | |
|---|---|---|---|
| 2,046,077 | 6/1936 | Johnson | 229/58 X |
| 2,387,640 | 10/1945 | Bouchelle | 222/561 |
| 2,419,182 | 4/1947 | Wells | 222/561 |
| 3,799,409 | 3/1974 | Goerke | 222/561 |
| 4,184,627 | 1/1980 | Achelpohl | 229/60 |

*Primary Examiner*—Donald F. Norton

*Attorney, Agent, or Firm*—Fleit & Jacobson

[57] ABSTRACT

A reclosable sack having a cross-bottom formed by folded-over side flaps has the confronting edges of the flaps spaced apart to define a slideway for a closure strip which is provided with a hole and is retained in the slideway by a cover sheet. When the closure strip is slid to a position where the hole is out of registry with emptying holes pierced in the material overlying and underlying the strip, the sack is substantially sealed.

4 Claims, 2 Drawing Figures

RECLOSABLE CROSS-BOTTOM SACK

Figure 1:
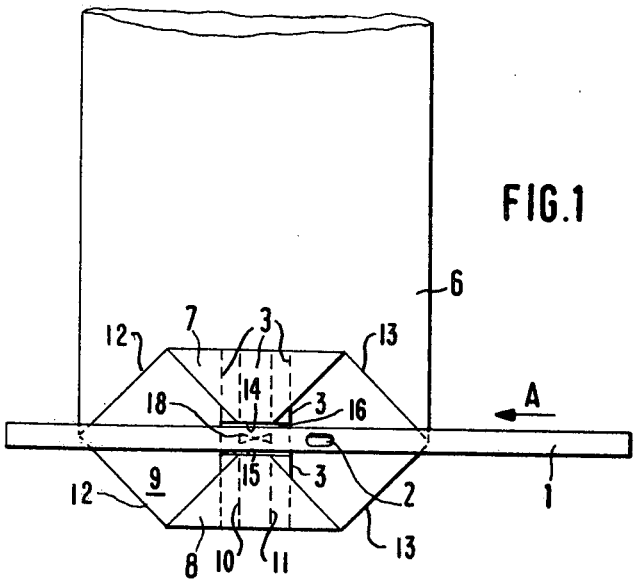

The invention relates to a reclosable cross-bottom sack consisting of a tube section in the pulled-open base square of which that is to be closed by folding over and adhering the side flaps and by adhering a base cover sheet to form a cross-bottom there is placed an internal lock connected to the confronting inner edges of the corner folds, and to a method of making same.

Particularly in the case of large capacity sacks of which the contents are not desired to be emptied all at once, there is the problem of closing the sacks again after some of the contents have been withdrawn. Since the filling end of the large sacks is usually employed to suspend same during transport and emptying, the filling end is not accessible for opening purposes and for emptying the contents. Such large sacks suspended for example from a crane hook by their filling aperture are usually opened by cutting open the base as is described in German Utility Model 78 17 554, dated June 12, 1978. However, such cutting open of the bases does not permit the withdrawal of partial quantities as is frequently required because of the large capacity of the sacks.

The present invention is intended to improve a cross-bottom sack of the type described in U.S. Pat. No. 4,184,627. Such sack is formed from a tubular section that has a base formed in the following manner:

(a) a tubular section is flattened and two diametrically opposite portions of the flattened section are pulled away from each to define two corner folds;

(b) the corner folds are triangular-shaped and have confronting parallel bases or inner edges spaced from each other to define a pulled open base square;

(c) an internal fastener or lock is applied to the base square in such manner that it closes or covers the space between the bases;

(d) confronting ends of the corner folds are folded towards the center of the base square, the folded over portions being commonly referred to as "side flaps"; and (e) a base cover sheet is applied to the folded over side flaps to complete formation of the base of the sack.

It is therefore the problem of the invention to provide a cross-bottom sack of the aforementioned kind which can be readily closed again after some of its contents have been removed.

According to the invention, this problem is solved in that the edges of the folded-over side flaps are spaced apart so that a channel is formed between the end faces of the edges as well as the internal lock or fastener and the base cover sheet, and that a strip of material which has a hole in its central region and forms a closure lock is inserted in this channel to project beyond both ends of the cover sheet. To open the sack which is freely suspended from its filling end, the closure lock is pushed into a position in which its hole is disposed substantially near the middle of the base. By means of a knife one can then pierce aligned holes through the hole of the closure lock into the base cover sheet as well as the internal lock. If the aligned emptying holes of the internal lock as well as the base cover sheet are to be closed again, the closure lock is displaced by pulling it at one end so that its hole leaves the vicinitly of the pierced holes and closes them again. If the hole in the closure lock is not brought into full registry with the pierced holes, the discharged quantity can be controlled.

The closure lock according to the invention avoids the need for completely destroying the base of the sack during emptying and consequently the empty sack can be re-used for other purposes.

The closure lock preferably consists of an elastic material of sufficient stiffness. Piercing of the base cover sheet as well as the internal lock to produce outlet apertures can be simplified if the base cover sheet and the internal lock are provided with aligned perforated portions in the region of the middle of the base.

A method of making the cross-bottom sack according to the invention is characterised according to the invention in that, after folding over the side flaps, the closure lock is inserted in the channel formed between their edges and the base cover sheet is stuck on with a two-component adhesive, the closure lock not being pretreated so that it will adhere neither to the base nor to the base cover sheet. According to the method of the invention, the closure lock need not be specially fitted into the base because, in the absence of pretreatment, the two-component adhesive that is used will not stick thereto but on the other hand will properly embed same therein so that a guide channel adapted thereto is formed in the base.

Figure 2:
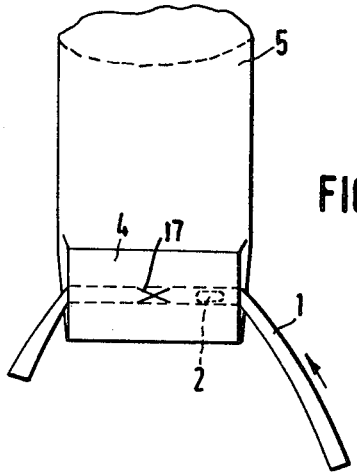

One example of the invention will now be described in more detail with reference to the drawing, wherein:

FIG. 1 is a plan view of the base folded into the plane of the flattened sack with the closure lock inserted and the base cover sheet lifted off, and FIG. 2 is a diagrammatic representation of a filled sack provided with opening incisions which are closed again by displacement of the closure lock.

The large sacks or container sacks illustrated in the drawing are provided with closure locks 1 at their base ends. These closure locks 1 comprise apertures 2 which, in the filled but closed or in the empty condition of the sacks, assume the positions shown in the drawing where they are disposed off-centre of the base. If, now, the base closure lock 1 is moved in the direction of the arrow A until the aperture 2 is disposed beneath the internal lock 3, one can cut through the base cover sheet 4 (which has been omitted from FIG. 1 for the sake of clarity) in the vicinity of the aperture 2, for example with a knife. Together with the base cover sheet 4, the internal lock 3 is also pierced by the knife so that the material within the sack 5 can flow out through the holes which were pierced into the internal lock 3 and the base cover sheet 4 and which are in registry with the aperture 2 of the base closure lock 1. If all the contents of the sack 5 are not to be emptied at once, the base closure lock 1 is moved opposite to the direction of the arrow A until the holes cut into the internal lock 3 and the base cover sheet 4 are no longer in registry with the aperture 2.

During production of the sack, a base square, generally designated 9, is first pulled open on a flattened tube section 6 and the internal lock 3 is welded or adhered onto the confronting inner edges or bases 10 and 11 of the corner folds 12 and 13. It will be appreciated that FIG. 1 illustrates the base square 9 after the base side flaps 7 and 8 have been turned over. When the base side flaps 7 and 8 are turned over, the inwardly turned confronting edges 14 and 15 of the base side flaps have end faces spaced from each other to define, in cooperation with the internal lock 3 and the base cover sheet 4, a channel 16. Onto the base that has thus been preformed and pretreated, a likewise pretreated base cover sheet is stuck by means of a two-component adhesive. However, before this base cover sheet 4 is stuck on, the base closure lock 1 is placed on it but this lock has not been pretreated for adhesion to the two-component adhesive. The base cover sheet 4 with the base closure lock 1 is then applied to the pulled-open base provided with an internal lock in a manner such that the base closure lock 1 assumes the position shown in FIG. 2, i.e. the base lock 1 bridges the space left vacant by the inner edges of the base side flaps 7, 8 as will be evident from FIG. 1.

The base closure lock 1 shown in FIG. 1 has been included only for clarity. It is applied to the preformed base together with the base cover sheet 4. Since the base closure lock 1 has not been pretreated, there is no connection between the base closure lock 1 and the base cover sheet 4 and the base of the sack after the two-component adhesive has cured. The lock 1 can therefore be displaced to and fro in the direction of the arrow A.

To facilitate opening of the base, the base cover sheet 4 as well as the internal lock 3 may be provided with aligned pre-perforated portions 17 and 18, respectively.

What is claimed is:

1. A reclosable cross-bottom sack consisting of a tube section having a pulled-open base square defined by spaced apart corner folds, the base square being closed by folding over and adhering side flaps formed by the corner folds, a base cover sheet adhered to the side flaps to form a cross-bottom, an internal lock connected to confronting inner edges of the corner folds, confronting edges of the folded-over side flaps being spaced apart so that a channel is formed between end faces of the side flap edges, the internal lock and the base cover sheet, and a strip of material having a hole in its central region forming a closure lock inserted in said channel to project beyond both ends of the cover sheet.

2. A cross-bottom sack according to claim 1, characterised in that the base cover sheet and the internal lock have aligned perforated portions in the region of the middle of the base.

3. In a sack formed from a tube section and having a base formed by pulling apart, folding inwardly and flattening portions of the section to define triangular shaped corner folds, the corner folds having parallel bases spaced from each other and confronting ends of the bases folded to define side flaps; an internal lock connected to inner portions of the corner folds for blocking the space between the bases of the corner folds; and a base cover sheet adhered to folded over portions of the side flaps and covering the internal lock blocking the space between the bases; the improvement comprising a strip of material forming a closure lock disposed for sliding movement in a channel defined between the internal lock, the base cover sheet, and confronting portions of the folded over side flaps, the lock having ends projecting beyond the base cover sheet, and a through opening formed in a central region thereof.

4. The improvement of claim 3, wherein the base cover sheet and the internal lock have aligned perforated portions in the region of the middle of the base.

* * * * *